US009694271B2

(12) United States Patent
Holovicz

(10) Patent No.: US 9,694,271 B2
(45) Date of Patent: Jul. 4, 2017

(54) SKI AND CLIMBING AID FOR ATTACHMENT TO A SKI

(71) Applicant: FISCHER SPORTS GMBH, Ried/Innkreis (AT)

(72) Inventor: Josef Holovicz, Mettmach (AT)

(73) Assignee: Fischer Sports GmbH, Ried/Innkreis (AT)

( * ) Notice: Subject to any disclaimer, the term of this patent is extended or adjusted under 35 U.S.C. 154(b) by 0 days.

(21) Appl. No.: 15/023,411

(22) PCT Filed: Sep. 18, 2014

(86) PCT No.: PCT/AT2014/050209
§ 371 (c)(1),
(2) Date: Mar. 21, 2016

(87) PCT Pub. No.: WO2015/039156
PCT Pub. Date: Mar. 26, 2015

(65) Prior Publication Data

US 2016/0213997 A1 Jul. 28, 2016

(30) Foreign Application Priority Data

Sep. 20, 2013 (AT) ..... A 50597/2013

(51) Int. Cl.
*A63C 7/08* (2006.01)
*A63C 7/04* (2006.01)
*A63C 5/06* (2006.01)

(52) U.S. Cl.
CPC ..... *A63C 7/08* (2013.01); *A63C 5/06* (2013.01); *A63C 7/04* (2013.01)

(58) Field of Classification Search
CPC .... A63C 5/06; A63C 7/04; A63C 7/08; A63C 7/02
(Continued)

(56) References Cited

U.S. PATENT DOCUMENTS 4,344,641 A * 8/1982 Lehn ..... A63C 5/04 114/67 A
6,105,990 A * 8/2000 Sutherland ..... A63C 7/04 280/604
(Continued)

FOREIGN PATENT DOCUMENTS

AT 163 089 5/1949
AT 114 63 11/2010
(Continued)

OTHER PUBLICATIONS

International Search Report for PCT/AT2014/050209 mailed Dec. 12, 2014, 2 pages.
(Continued)

*Primary Examiner* — Brian Swenson
(74) *Attorney, Agent, or Firm* — Nixon & Vanderhye P.C.

(57) ABSTRACT

The invention relates to a ski having a sliding surface and a ski upper face opposite the sliding surface, wherein a climbing aid can be attached to the sliding surface and the ski has a continuous through-hole in an area located before a contact surface, which through-hole extends from the sliding surface to the ski upper face. According to the invention, a securing element is arranged on the ski upper face which securing element comprises at least one holding element for the form-fitting connection to a corresponding counter element of the climbing aid.

21 Claims, 3 Drawing Sheets

Figure 1:
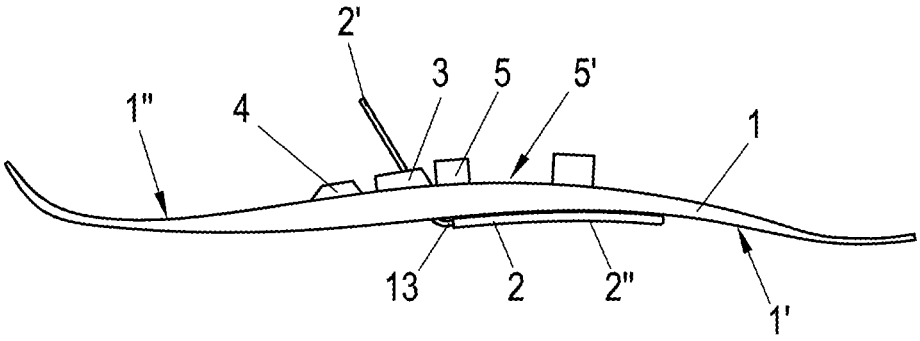

(58) Field of Classification Search
USPC ..... 280/604
See application file for complete search history.

(56) References Cited

U.S. PATENT DOCUMENTS

| | | | | |
|---|---|---|---|---|
| 6,604,755 | B2 * | 8/2003 | Ayliffe | A63C 11/00 280/604 |
| 8,474,853 | B2 * | 7/2013 | Rogers | A63C 7/04 280/604 |
| 2006/0138747 | A1 * | 6/2006 | Hartmann | A63C 7/04 280/604 |
| 2006/0267332 | A1 * | 11/2006 | Fischli | A63C 7/04 280/809 |

FOREIGN PATENT DOCUMENTS

| | | |
|---|---|---|
| CH | 674622 | 6/1990 |
| DE | 924496 | 3/1955 |
| EP | 1 329 245 | 7/2003 |

OTHER PUBLICATIONS

Written Opinion of the ISA for PCT/AT2014/050209 mailed Dec. 12, 2014, 2 pages.
Written Opinion of the IPEA for PCT/AT2014/050209 dated Sep. 3, 2015, 4 pages.
International Preliminary Report on Patentability for PCT/AT2014/050209 dated Dec. 4, 2015, 15 pages.
AT Office Action for A 50597/2013 dated Aug. 4, 2014, 4 pages.
English translation of the International Preliminary Report on Patentability mailed Mar. 24, 2016, issued in International Application No. PCT/AT2014/050209.

* cited by examiner

SKI AND CLIMBING AID FOR ATTACHMENT TO A SKI

This application is the U.S. national phase of International Application No. PCT/AT2014/050209 filed 18 Sep. 2014 which designated the U.S. and claims priority to Austria Patent Application No. A 50597/2013 filed 20 Sep. 2013, the entire contents of each of which are hereby incorporated by reference.

The invention relates to a ski having a sliding surface and a ski upper face opposite the sliding surface, wherein a climbing aid can be attached to the sliding surface and the ski has a continuous through-hole in an area located before a contact surface, which through-hole extends from the sliding surface to the ski upper face. Furthermore, the invention relates to a climbing aid for attachment to a ski in accordance with the invention, and to a securing element for the ski in accordance with the invention.

It is sufficiently known to provide skis with a climbing aid, in particular with a climbing skin, so as to facilitate climbing for a user, especially when making ski tours. Especially climbing aids are known which extend, in the mounted state, from the ski tip to the ski end, and which accordingly have to be dismounted as a rule also for short downhill runs in order to ensure sufficient sliding properties of the ski.

In particular in so-called back country skiing in which usually (cross-country) skis with steel edges are used in untracked territories it is, however, desired to offer skis with climbing aids which do not cover the sliding surface in the shovel region and/or end region of the ski, so that a climbing aid is offered for climbing, on the one hand, and short downhill runs may performed in truncated territory with sufficient sliding properties without dismounting the climbing aid, on the other hand. However, for long downhill runs, the climbing aid will be removed and attached again for the next raising.

WO 2004/064949 A1 already discloses a ski in which a through-hole is provided in an area of the ski located before its contact surface, so that the sliding surface of the ski is not covered by the climbing aid especially in the region of a front shovel section even in the mounted state of the climbing aid. For attaching the climbing aid, a connection element is received in the through-hole of the ski which comprises two hook openings in which connection hooks of a holding element of the climbing aid are received. In the inserted state the connection hooks are received in the hook openings within the through-hole such that the climbing aid is attached to the sliding surface of the ski.

It is especially disadvantageous here that snow and/or ice may enter the openings of the connection element from the ski upper face, which entails the danger that the connection hooks freeze on in the connection element. It is also a disadvantage that the user then does not have direct access to the connection positions frozen on.

Furthermore, AT 11 463 U1 discloses a ski with a through-hole in an area located before its contact surface thereof, wherein here a bore produced by means of a spiral drill is disclosed in which bore a centering bolt of a skin holding plate is suspended. This centering bolt is then preferably retained in the through-hole by a nut provided with an internal thread which nuts gets into contact with a housing received in the opening.

DE 924 496 discloses a further device for attaching a climbing skin to a ski. In this state of the art, holding plates are attached to the climbing skin. The holding plates carry holding pins guided in drilled through-holes of the ski along the guiding groove of the outer sole. The climbing skin is attached to the ski tip by a tensioning device.

CH 674 622 describes further means for the removable attachment of a climbing aid to a ski. A plate which is disposed removably on the ski underside by means of a screw piercing the ski is attached to the climbing aid.

Accordingly, the state of the art discloses solutions in which the climbing aid is directly retained by means of connection claws or a screw connection on a housing received in the through-hole. This has the disadvantage that tensile forces act on the housing received in the through-hole and/or that different forces act on the housing when the climbing aid is attached/removed, so that there is the danger of loosening the housing in the through-hole.

In accordance with the invention, however, the climbing aid merely is to be guided through the through-hole and the securing of an end of the climbing skin is to be decoupled from the through-hole and/or a housing received therein.

In accordance with the invention this is achieved in that a securing element is arranged on the ski upper face which securing element comprises at least one holding element for the form-fitting connection to a corresponding counter element of the climbing aid. Accordingly, the ski in accordance with the invention comprises a securing element on the ski upper face so as to secure the free end of the climbing aid in a simple manner to the face opposite the sliding surface. Thus, freezing on of the fee end of the climbing aid within the through-hole is prevented reliably, on the one hand, and possible tensile forces and/or forces occurring during the mounting/dismounting of the climbing aid are not transferred directly into the through-hole and/or to a housing received therein, on the other hand.

In order to secure a free end of the climbing aid to the ski upper face in a simple and quick manner it is favorable if the securing element comprises as a holding element at least one projection, preferably two laterally disposed projections, in particular in the kind of snap-in lugs.

In order to ensure a reliable connection between the securing element and the holding element and/or to pull the counter element downward in the direction of the ski upper face if tension force is exerted on the climbing aid, it is favorable if the projection comprises an abutment face extending from the ski upper face obliquely forward to a tip of the ski, wherein the abutment face preferably forms an angle of between 20° and 50°, in particular of substantially 30°, with the ski upper face.

In order to attach the securing element separately to the ski upper face and thus deflect possible tensile forces via the securing element into the ski body independently of the through-hole, it is favorable if the securing element comprises an extension directed toward the ski upper face, said extension being received in a corresponding recess of the ski in the mounted state.

In order to insert the climbing aid without sharp edges from the sliding surface into the through-hole and/or to be able to favorably assume possible tensile forces acting on the securing element, it is beneficial if a longitudinal axis of the through-hole and/or of the recess for receiving the extension is inclined in the direction of the tip of the ski and forms in particular an angle of between 20° and 50°, preferably of substantially 30°, with the plane of longitudinal extension of the ski upper face.

The securing element may be designed as a separate component, on the one hand, and is, especially with the aid of the extension, attached separately to the ski upper face. Nevertheless, for reducing the number of pieces it is of advantage if the securing element is designed integrally with a guide housing which extends at least partially into the through-hole and preferably lines the through-hole essentially completely.

In order to simplify the positioning of the counter element relative to the securing element for the user, it is of advantage if the securing element comprises two lateral guiding ridges.

A particularly torsion-resistant, stable design of the securing element which is preferably manufactured of plastics exists if the guiding ridges are designed preferably integrally with a bottom face, wherein the projections are each connected with the bottom face and the guiding ridge.

The climbing aid in accordance with the invention for attachment to a ski in accordance with the invention is characterized in that the climbing aid comprises at a front end thereof a counter element for connection with the holding element. Thus, by simple guiding the counter element through the through-hole and the subsequent form-fitting connection with the securing element it is possible to achieve a reliable connection between the climbing aid and the ski in a quick and simple manner.

In order to keep elements projecting from the ski upper face as small as possible it is of advantage if the counter element is designed in the kind of a tab.

With respect to a simple, reliable connection between the counter element and the holding element it is beneficial if the tab-shaped counter element comprises two edge-sided material recesses for receiving the projections of the securing element.

With respect to a reliable, form-fitting connection between the counter element and the securing element it is furthermore advantageous if a plastic element which is torsion-resistant relative to the climbing aid is provided as a counter element.

In order to be able to guide the climbing aid through the through-hole in a simple manner and to simultaneously offer the user a convenient counter element for the purpose of securing the climbing aid, it is beneficial if the breadth of the climbing aid tapers in a front end section such that the breadth of the climbing aid is smaller than the breadth of the through-hole and/or smaller than a through-opening of the guide housing.

In order to be able to secure the climbing aid to the ski in a simple manner it is of further advantage if the climbing aid comprises a guide-through element between the counter element and a resilient anti-slip section effectively serving as a climbing aid.

In order to enable the user to insert the guide-through element in a simple manner in the through-hole and to reliably hold the climbing aid, on the other hand, it is of advantage if the guide-through element consists of a resilient plastic material and is firmly connected with the counter element, preferably designed as a 2 component injection molded part.

Furthermore, for improving the sliding properties of the climbing aid it is of advantage if the length of the guide-through element is, preferably by 10 to 30%, larger than the length of the through-hole. In this case, the climbing aid may be attached to the ski such that the guide-through element, which has better sliding properties as compared to the climbing aid, is arranged to be exposed in the transition region between the sliding surface and the through-hole, so that the sliding properties of the ski with mounted climbing aid are improved with such an arrangement of the climbing aid.

For achieving efficient anti-slip properties with the climbing aid it is especially advantageous if the climbing aid comprises a carrier layer which is provided with bristles for forming a climbing skin, or comprises scales or the like, or is coated with grip wax.

Figure 3:
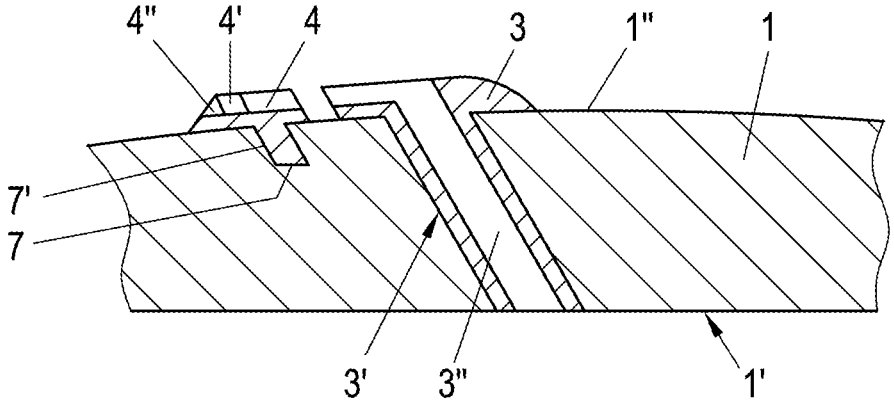
Figure 2:
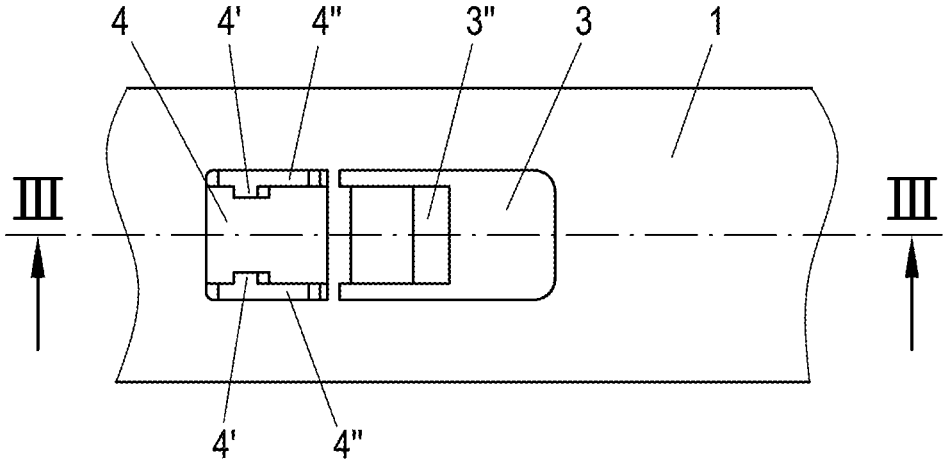
Figure 3A:
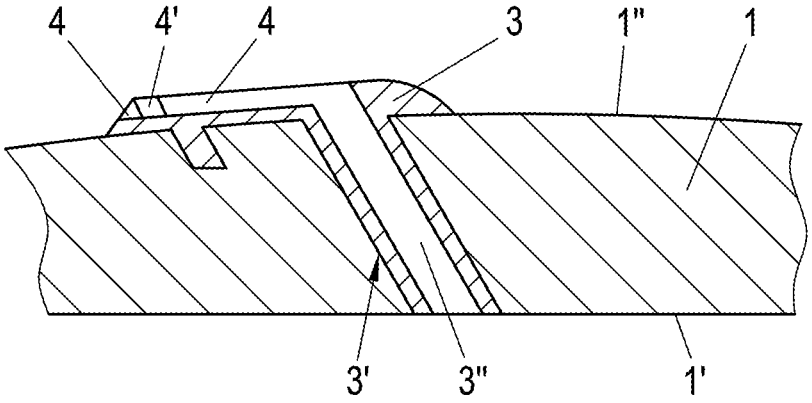
Figure 4:
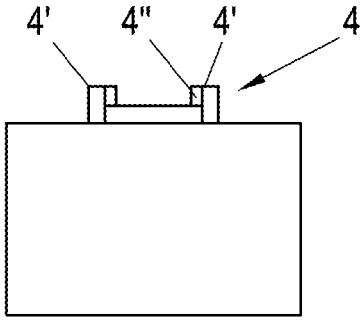
Figure 5:
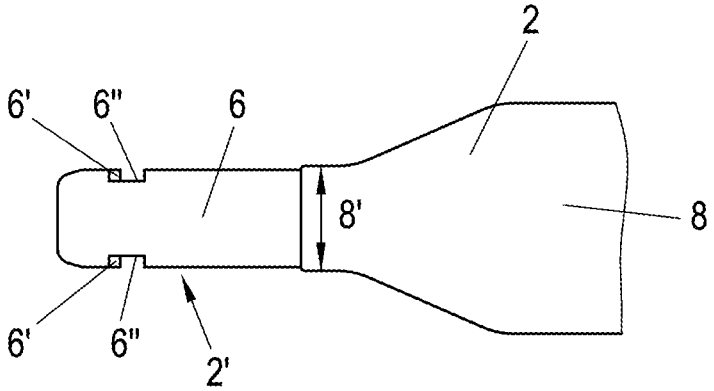
Figure 6:
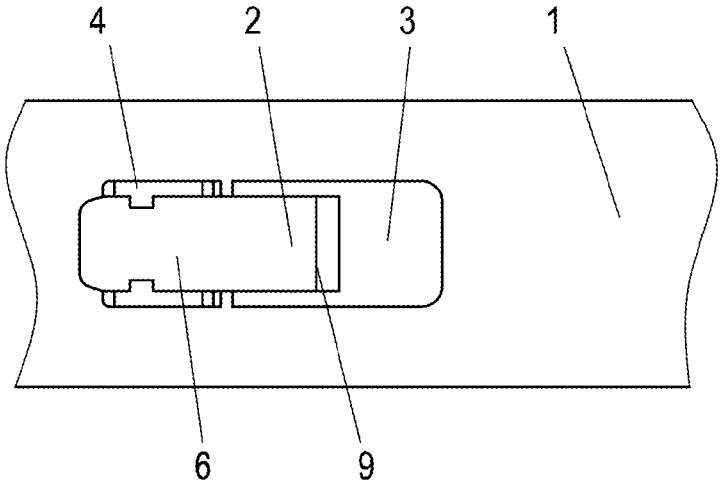
Figure 7:
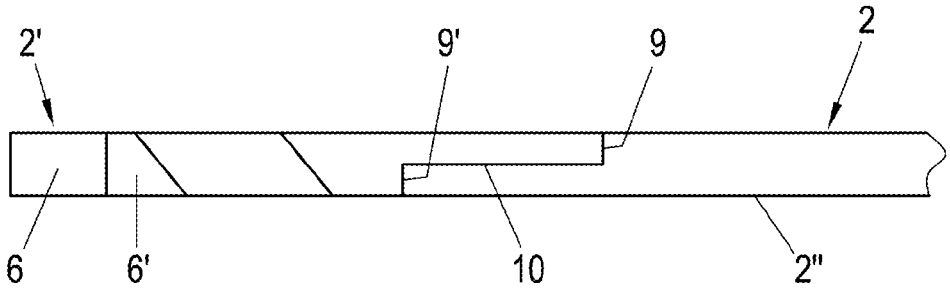

In the following the invention will be explained in detail by means of preferred embodiments to which it is, however, not meant to be restricted at all. In detail, the drawings show:

FIG. 1 a side view of a ski with a through-hole before a contact surface of the ski;

FIG. 2 a plan view of the ski in the region of the through-hole;

FIG. 3 a section pursuant to the line III-III in FIG. 2;

FIG. 3*a* an alternative embodiment in the same sectional view as FIG. 3;

FIG. 4 a front view of a securing element;

FIG. 5 a front end of a climbing aid;

FIG. 6 a plan view of the ski with a counter element secured in the holding element;

FIG. 7 a side view of the front end of the climbing aid; and

Figure 8:
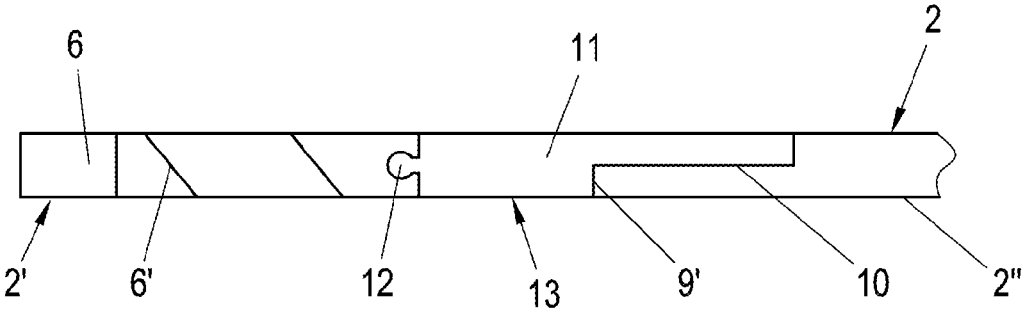

FIG. 8 a side view of a further embodiment of a front end of the climbing aid.

FIG. 1 illustrates a ski 1 having a sliding surface 1' and a ski upper face 1" opposite the sliding surface 1'. In the central region of the sliding surface 1' a climbing aid 2 is removably disposed and is provided to prevent slipping of the ski when climbing. Such climbing aids 2, especially with a scale-like structure, and/or climbing skins with oblique bristles are sufficiently known in the state of the art.

The climbing aid 2 comprises a front end 2' which was guided through a guide housing 3 before and is arranged at the side of the ski upper face 1" in FIG. 1. In the position illustrated in FIG. 1 the free end 2' has not yet been connected with a securing element 4 which is disposed at the ski upper face 1".

As may be seen in particular in FIG. 3, the guide housing 3 is provided for lining a through-hole 3' in the ski 1 and thus protecting the layers of the ski 1, which would otherwise be exposed in the region of the through-hole 3', especially from contact with snow and/or ice. FIG. 1 shows that the guide housing 3 and/or the through-hole 3' is/are provided in an area located before the (front) binding jaw 5, wherein the binding jaw 5 is followed by a contact surface 5' in the region of which the user usually stands with the sole of a ski shoe in the case of load. In the region of the contact surface 5' a push-off force by the user is accordingly introduced into the ski 1. In particular in this region the climbing aid 2 is accordingly provided on the side of the sliding surface 1'.

In the plan view of the ski upper face 1" pursuant to FIG. 2 the guide housing 3 and the securing element 4 which is designed separately from the guide housing 3 are illustrated. The guide housing 3 received in the through-hole 3' in the ski 1 comprises a through-opening 3" extending through the ski 1.

For securing the free end 2' of the climbing aid 2, the securing element 4 comprises a holding element 4' in the form of two projections which are provided for receiving a counter element 6 mounted on the free end 2' of the climbing aid 2 (cf. FIG. 5). The two projections 4' comprise abutment faces 4" extending obliquely backward so as to form an undercut at which corresponding hook-shaped projections 6' of the counter element 6 get into form-fitting abutment. The hook-shaped projections 6' are formed in a simple manner by two edge-sided material recesses 6" in the counter element 6.

The securing element 4 additionally comprises two lateral guiding ridges 4'", so that the introduction of the counter element 6 in a connected position is facilitated. The projections 4' are moreover formed integrally with the lateral guiding ridges 4''' and a bottom face of the securing element, so that a torsion-resistant, substantially tub-shaped securing element 4 results.

In the sectional view illustrated in FIG. 3 it may in particular be recognized that the guide housing 3 completely lines the through-hole 3' and completely extends through the ski 1. At the side of the sliding surface 1' the guide housing 3 is flush with the ski 1, whereas at the ski upper face 1" the guide housing 3 comprises a cover to protect the interior of the ski from the penetration of water.

Separately from the guide housing 3 at the ski upper face 1" the securing element 4 is attached for securing the free end 2' of the climbing aid 2. For this purpose the securing element 4 comprises a mandrel-like extension 7 directed toward the ski upper face 1" and being received in a form-fitting manner in a corresponding recess in the ski 1. Preferably, a longitudinal axis of the extension 7 extends substantially parallel to a longitudinal axis of the through-hole 3'. In the illustrated embodiment the longitudinal axes form an angle of approx. 30° with the plane defining the ski upper face 1".

In the embodiment illustrated in FIG. 3 the securing element 4 is designed as a part separate from the guide housing 3. As may be seen in FIG. 3*a*, for reducing the number of pieces it is, however, likewise possible to design the securing element 4 mounted on the ski upper face 1" integrally with the guide housing 3.

FIG. 5 illustrates the front end 2' of the climbing aid 2 which may e.g. consist of a climbing skin, a plastic film with scales or the like, for instance, a film coated with grip wax. The climbing aid 2 has an effective breadth 8 comprising preferably between 30 and 90% of the entire ski breadth. This breadth 8 tapers up to the counter element 6 to a breadth 8' which is by approx. 10 to 30% smaller than the breadth of the through-opening 3" of the guide element 3, so that the climbing aid 2 may be guided through the through-opening 3" with the front end thereof.

Advantageously, the climbing aid 2 is, e.g. like a conventional climbing skin, designed to be flexible, so that it may be bent back at the lower end of the through-hole 3' and bent forward at the upper end of the through-hole 3' in practical use.

The counter element 6 of the climbing aid 2 consists of a solid plastic material which is preferably manufactured in an injection molding process, and is connected in a force-fitting manner with the rest of the climbing aid 2, for instance, by gluing, sewing, riveting, welding, or the like. In the embodiment pursuant to FIG. 5 the counter element 6 has oblique flanks 6' which are adapted to be connected in a form-fitting manner with the corresponding oblique flanks 4" of the holding element 4.

In the plan view of the ski 1 pursuant to FIG. 6 the counter element 6 is connected with the securing element 4 in a usage position, i.e. in a form-fitting manner, so that the end 2' of the climbing aid 2 is fixed stationary with respect to the ski 1. Furthermore, it may be seen that the connection between the climbing aid 2 and the counter element 6 along a line 9 lies in front of the confinement of the guide element, so that the climbing aid 2 may be angled forward easily.

FIG. 7 illustrates a preferred embodiment of the front end 2' of the climbing aid 2 pursuant to FIG. 5 with the counter element 6 which comprises oblique flanks 6' and a step 9'. The connection between the counter element 6 and the climbing aid 2 thus extends along a connection face 10. This embodiment in particular has the advantage that a flexible anti-slip section and/or a carrier layer 2" of the climbing aid 2 can be connected easily with the comparatively stiff counter element 6.

FIG. 8 illustrates a further preferred embodiment of the front end 2' of the climbing aid 2 with the counter element by interconnecting an element 11 consisting of an elastic plastic material. This element 11 may, for instance, be manufactured in a 2-component injection molding process, possibly with the incorporation of an undercut 12, with the counter element 6 in a simple manner. The effective anti-slip section and/or the carrier layer 2" of the climbing aid 2 is mounted at the rear end of the element 11.

The element 11 has a length which is larger than the length of the through-hole 3', preferably by 10 to 30%. This ensures that, in the usage position, a section 13 of the flexible plastic part, as illustrated schematically in FIG. 1, due to its length extends beyond the lower bend and the sliding property of the climbing aid 2 is thus improved. At the same time, the element 11 also projects above the through-hole 3' in the direction of the ski upper face 1", so that a simple deflection for the purpose of connecting the counter element 6 with the securing element 4 is also ensured.

The invention claimed is:

1. A ski having a sliding surface and a ski upper face opposite the sliding surface, wherein a climbing aid is attached to the sliding surface and the ski has a continuous through-hole in an area located before a contact surface, said through-hole extends from the sliding surface to the ski upper face and in which a guide housing comprising a through-opening is received, wherein the through-hole is provided for guiding through the climbing aid and a securing element is arranged on the ski upper face separately from the guide housing, said securing element comprises an extension directed toward the ski upper face which extension is received in a corresponding recess of the ski in the mounted state, wherein the securing element comprises at least one holding element for the form-fitting connection with a corresponding counter element of the climbing aid.

2. The ski according to claim 1, wherein the securing element comprises as a holding element at least one projection.

3. The ski according to claim 2, wherein the projection comprises a respective abutment face extending from the ski upper face obliquely forward to a tip of the ski.

4. The ski according to claim 3, wherein a longitudinal axis of the through-hole and/or of the recess for receiving the extension is inclined in the direction of the tip of the ski.

5. The ski according to claim 3, wherein a longitudinal axis of the through-hole and/or of the recess for receiving the extension is inclined in the direction of the tip of the ski and forms an angle of substantially 30° with the plane of the longitudinal extension of the ski upper face.

6. The ski according to claim 2, wherein the projection comprises a respective abutment face extending from the ski upper face obliquely forward to a tip of the ski, wherein the abutment face forms an angle of between 20° and 50° with the ski upper face.

7. The ski according to claim 2, wherein the projection comprises a respective abutment face extending from the ski upper face obliquely forward to a tip of the ski, wherein the abutment face forms an angle of substantially 30° with the ski upper face.

8. The ski according to claim 1, wherein the securing element is formed integrally with a guide housing which extends at least partially into the through-hole.

9. The ski according to claim 1, wherein the securing element comprises two lateral guiding ridges.

10. The ski according to claim 9, wherein the guiding ridges are preferably formed integrally with a bottom face, wherein the projections of the holding element are each connected with the bottom face and the guiding ridge.

11. A climbing aid for attachment to a ski according to claim 1, wherein the climbing aid comprises, at a front end, a counter element, in particular in the kind of a tab, for connection with the holding element, wherein the breadth of the climbing aid in a front end section tapers such that the breadth of the climbing aid is smaller than the through-opening of the guide housing, so that the climbing aid may be guided through the through-hole and the counter element is connectable with the holding element disposed at the ski upper face.

12. The climbing aid according to claim 11, wherein the tab-shaped counter element comprises two edge-sided material recesses for receiving the projections of the securing element.

13. The climbing aid according to claim 11, wherein a plastic element resistant to bending relative to the climbing aid is provided as a counter element.

14. The climbing aid according to claim 11, wherein the climbing aid comprises a guide-through element between the counter element and a resilient anti-slip section effectively serving as a climbing aid.

15. The climbing aid according to claim 14, wherein the guide-through element consists of a resilient plastic material and is firmly connected with the counter element.

16. The climbing aid according to claim 14, wherein the guide-through element consists of a resilient plastic material and is firmly connected with the counter element, designed as a 2-component injection molded part.

17. The climbing aid according to claim 11, wherein the climbing aid comprises a carrier layer provided with bristles for forming a climbing skin, or comprises scales or the like, or is coated with grip wax.

18. The ski according to claim 1, wherein the securing element comprises as a holding element two laterally disposed projections.

19. The ski according to claim 1, wherein the securing element comprises as a holding element two laterally disposed projections in the kind of snap-in lugs.

20. The ski according to claim 3, wherein a longitudinal axis of the through-hole and/or of the recess for receiving the extension is inclined in the direction of the tip of the ski and forms an angle of between 20° and 50° with the plane of the longitudinal extension of the ski upper face.

21. The ski according to claim 1, wherein the securing element is formed integrally with a guide housing which lines the through-hole substantially completely.

* * * * *